US010088779B2

(12) United States Patent
Ishizuka et al.

(10) Patent No.: US 10,088,779 B2
(45) Date of Patent: Oct. 2, 2018

(54) DEVELOPING DEVICE AND IMAGE FORMING APPARATUS

(71) Applicant: Konica Minolta, Inc., Chiyoda-ku, Tokyo (JP)

(72) Inventors: Kazuteru Ishizuka, Saitama (JP); Tatsuya Furuta, Tokyo (JP); Hiroshi Morimoto, Tokyo (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/634,113

(22) Filed: Jun. 27, 2017

(65) Prior Publication Data

US 2018/0004127 A1 Jan. 4, 2018

(30) Foreign Application Priority Data

Jun. 29, 2016 (JP) ..... 2016-128953

(51) Int. Cl.
*G03G 15/09* (2006.01)

(52) U.S. Cl.
CPC ..... *G03G 15/0928* (2013.01); *G03G 15/0921* (2013.01)

(58) Field of Classification Search
CPC ..... G03G 15/0921; G03G 15/0928; G03G 15/09; G03G 2215/0618; G03G 2215/0609; G03G 2215/0811
See application file for complete search history.

(56) References Cited

U.S. PATENT DOCUMENTS 6,061,541 A * 5/2000 Bessette ..... G03G 15/0921 399/277
7,031,645 B2 * 4/2006 Mashtare ..... G03G 15/09 399/266
2003/0185600 A1 * 10/2003 Mabuchi ..... G03G 15/0921 399/269
2011/0150538 A1 * 6/2011 Sakurai ..... G03G 15/0921 399/276
2013/0202330 A1 * 8/2013 Ochi ..... G03G 15/0896 399/269

FOREIGN PATENT DOCUMENTS

JP 09-034255 A 2/1997
JP 2004-302334 A 10/2004

OTHER PUBLICATIONS

Machine translation of JP 09-034255 A (publication date of Feb. 7, 1997) printed on Apr. 18, 2018.*

* cited by examiner

*Primary Examiner* — Sophia S Chen
(74) *Attorney, Agent, or Firm* — Buchanan Ingersoll & Rooney PC

(57) ABSTRACT

A developing device includes a developing roller which includes: a magnet roller having a plurality of magnetic poles in a circumferential direction; and a developing sleeve rotatably supported along an outer peripheral surface of the magnet roller, and which is configured to supply a toner to an image bearing member. The magnet roller is configured so that the relative position thereof to the developing sleeve is changeable.

9 Claims, 8 Drawing Sheets

DEVELOPING DEVICE AND IMAGE FORMING APPARATUS

CROSS REFERENCE TO RELATED APPLICATIONS

This application is entitled to, and claims the benefit of Japanese Patent Application No. 2016-128953, filed on Jun. 29, 2016, the disclosure of which including the specification, drawings and abstract is incorporated herein by reference in its entirety.

BACKGROUND OF THE INVENTION

1. Field of the Invention

The present invention relates to a developing, device and an image forming apparatus.

2. Description of Related Art

As developing devices used in image forming apparatuses, such as electrophotographic copiers, printers, and facsimiles, a developing device that performs development using a two-component developer containing a toner and a carrier has widely been used.

An electrophotographic developing process typically forms a latent image by evenly charging a surface of a photoconductor drum (image bearing member) followed by exposure, and visualizes the latent image by applying developing bias to a developing roller (developer bearing member) and bringing a developer into contact with the photoconductor drum.

There is an image forming apparatus in which a developing device is detached from an image forming apparatus body and replaced when the amount of a developer stored inside the developing device decreases (see Japanese Patent Application Laid-Open No. 2004-302334, for example).

When a developing device is replaced, however, the developing device (more specifically, a developing roller that supplies a developer to a photoconductor drum) sometimes fails to be disposed at an accurate position relative to the photoconductor drum, depending on the installation state after the replacement. In this case, the rotational axis of the photoconductor drum and the rotational axis of the developing roller fail to align in parallel, and thus variations in the amount of a developer conveyed from the developing roller to the photoconductor drum result, causing a problem in which uneven development arises.

SUMMARY OF THE INVENTION

An object of the present invention is to provide a developing device and an image forming apparatus that can prevent uneven development in the rotational axis direction of an image bearing member.

To achieve at least one of the abovementioned objects, a developing device reflecting one aspect of the present invention includes a developing roller, configured to supply a toner to an image bearing member, including a magnet roller having a plurality of magnetic poles in a circumferential direction and a developing sleeve rotatably supported along an outer peripheral surface of the magnet roller, in which the magnet roller is configured such that a relative position thereof to the developing sleeve is changeable.

In the aforementioned developing device, it is preferable that the developing roller is more than one, and in at least one of the developing rollers, the magnet roller is configured such that a relative position thereof to the developing sleeve is changeable.

In the aforementioned developing device, it is preferable that the developing rollers are a first developing roller, disposed on an upstream side of a rotation direction of the image bearing member, including a first magnet roller and a first developing sleeve; and a second developing roller, disposed on a downstream side of a rotation direction of the image bearing member, including a second magnet roller and a second developing sleeve, in which the first magnet roller is configured such that a relative position thereof to the first developing sleeve is changeable to align an axial direction of the first magnet roller and an axial direction of the second magnet roller in parallel.

In the aforementioned developing device, it is preferable that first developing roller rotates so that a peripheral surface thereof moves in a same direction as the image bearing member at a position facing the image bearing member, and the second developing roller rotates so that a peripheral surface thereof moves in an opposite direction to the image bearing member at a position facing the image bearing member.

In the aforementioned developing device, it is preferable that an amount of a developer to be borne on the first developing roller is not restricted, whereas an amount of a developer to be borne on the second developing roller is restricted.

In the aforementioned developing device, it is preferable that the first magnet roller is configured such that a relative rotation position thereof to the first developing sleeve is changeable, and the relative position and the relative rotation position are changed in accordance with a fluctuation in rotational torque of the first magnet roller, which results when the relative position and the relative rotation position are changed.

In the aforementioned developing device, it is preferable that the relative position is changed using a changing member provided at an end portion in an axial direction of the second magnet roller.

In the aforementioned developing device, it is preferable that, after the relative rotation position is changed, the first magnet roller is fixed to a housing for the developing device, using a fixing member provided at an end portion in an axial direction of the first magnet roller.

An image forming apparatus reflecting another aspect of the present invention includes the aforementioned developing device.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
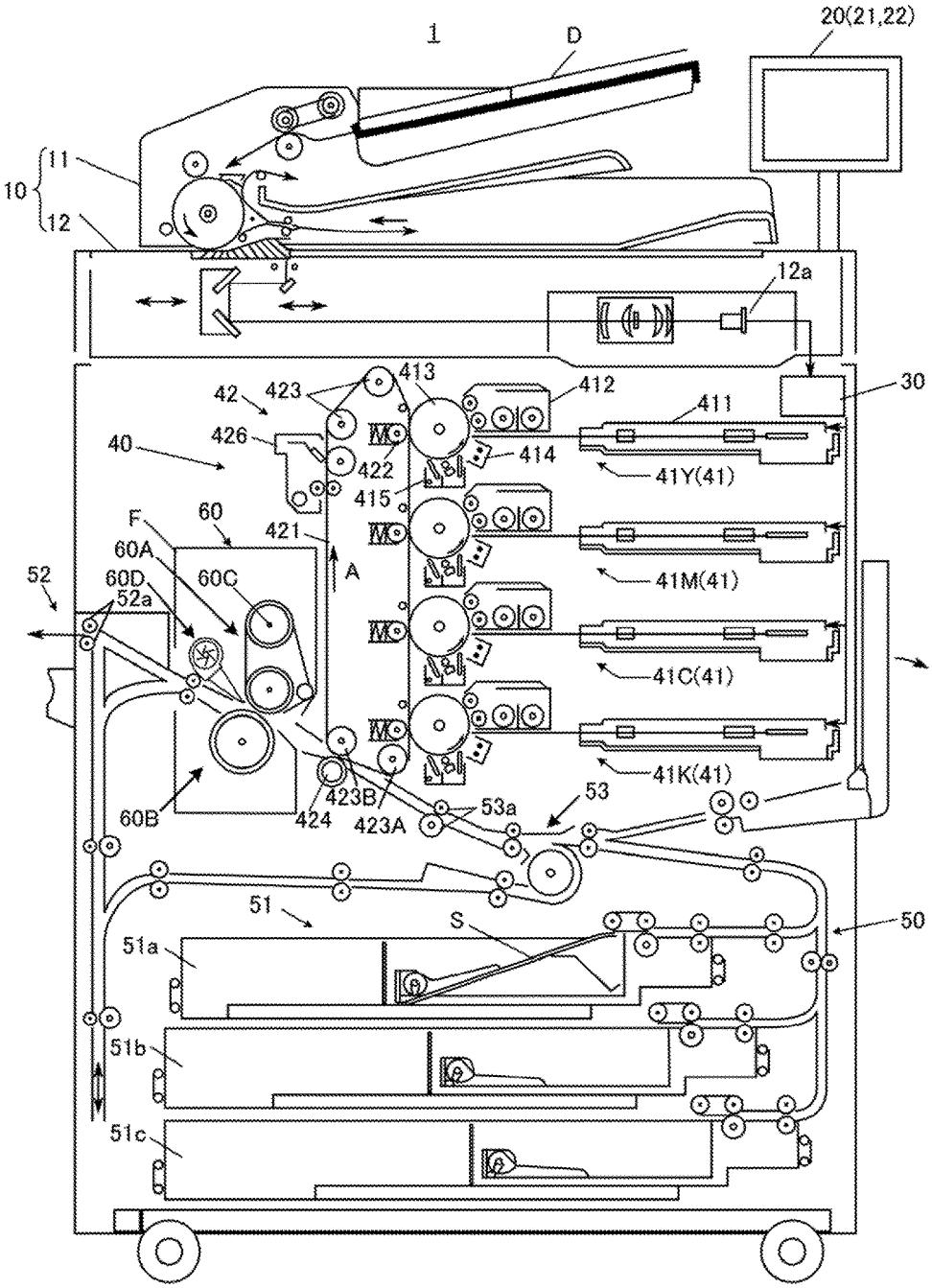
FIG. 1 schematically illustrates a whole configuration of an image forming apparatus according to an embodiment.
Figure 2:
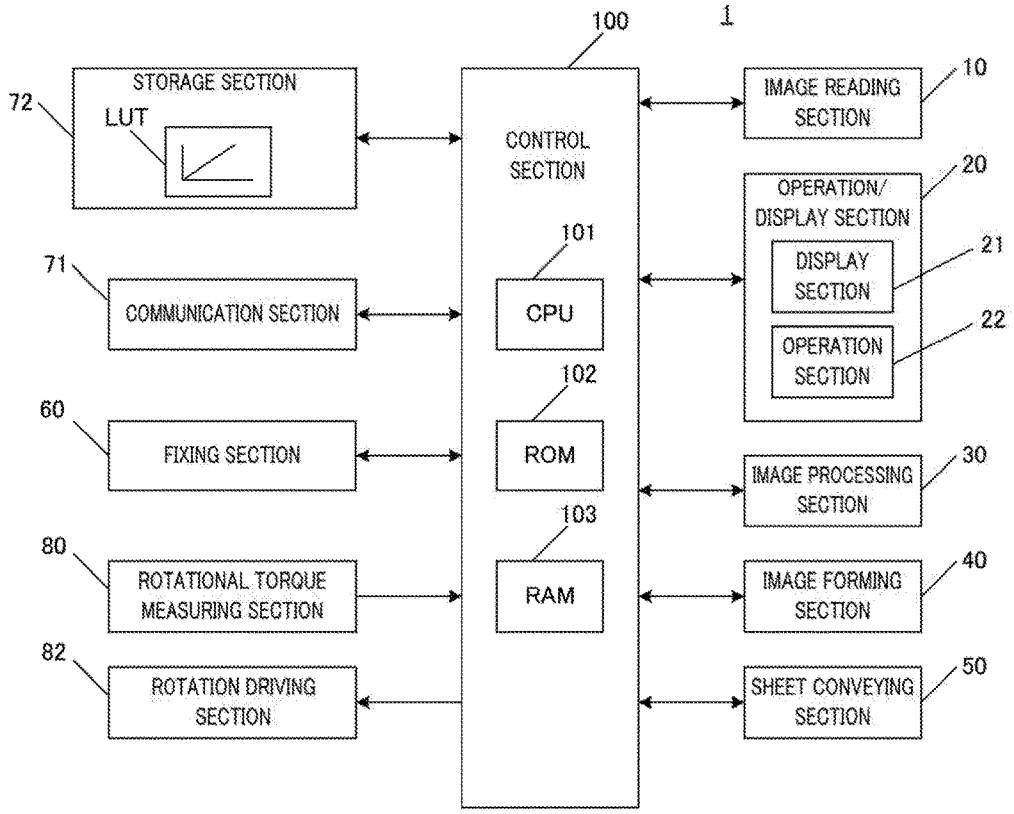
FIG. 2 shows a main section of a control system of the image forming apparatus according to the embodiment.

In the following, the present embodiment will be described in detail with reference to the drawings. FIG. 1 schematically illustrates a whole configuration of image forming apparatus 1 according to the embodiment of the present invention. FIG. 2 shows a main section of a control system of image forming apparatus 1 according to the embodiment. Image forming apparatus 1 illustrated in FIGS. 1 and 2 is an intermediate transfer-mode color image forming apparatus utilizing electrophotographic process. Image forming apparatus 1 transfers each color toner image of yellow (Y), magenta (M), cyan (C), and black (K) formed on photoconductor drum 413 to intermediate transfer belt 421 (primary transfer), superimposes the four color toner images on intermediate transfer belt 421, and then transfers to sheet S to form a toner image (secondary transfer).

Image forming apparatus 1 employs a tandem mode in which photoconductor drums 413 corresponding to four colors of Y, M, C, and K are disposed in series along the running direction of intermediate transfer belt 421, and color toner images are successively transferred to intermediate transfer belt 421 in a single procedure.

As shown in FIG. 2, image forming apparatus 1 includes image reading section 10, operation/display section 20, image processing section 30, image forming section 40, sheet conveying section 50, fixing section 60, rotational torque measuring section 80, rotation driving section 82, control section 100, and/or the like. Rotational torque measuring section 80 and rotation driving section 82 will be described hereinafter.

Control section 100 includes central processing unit (CPU) 101, read-only memory (ROM) 102, random-access memory (RAM) 103, and/or the like. CPU 101 reads from ROM 102 a program corresponding to processing details, loads the program into RAM 103, and performs, cooperatively with the loaded program, centralized control of the operation in respective blocks of image forming apparatus 1. During this step, various data stored in storage section 72 are referred to. Storage section 72 is composed of, for example, a nonvolatile semiconductor memory (so-called flash memory) and/or a hard disk drive.

Control section 100 transmits and receives various data to and from an external apparatus (personal computer, for example) connected to a communication network, such as a local area network (LAN) or a wide area network (WAN), via communication section 71. Control section 100, for example, receives image data transmitted from an external apparatus, and operates to form a toner image on sheet S based on the image data (input image data). Communication section 71 is composed of, for example, a network interface card, such as a LAN card.

Image reading section 10 includes auto document feeder (ADF) 11, document image scanner 12, and/or the like.

Auto document feeder 11 conveys, with a conveying mechanism, document D placed on a document tray and sends it to document image scanner 12. Auto document feeder 11 can continuously and simultaneously read images on many documents ID (includes both-side ones) placed on a document tray.

Document image scanner 12 optically scans documents conveyed from auto document feeder 11 onto a contact glass or documents placed on a contact glass, and images reflected light from the documents on a light receiving surface of charge coupled device (CCD) sensor 12*a* to read document images. Image reading section 10 generates input image data based on results read by document image scanner 12. The input image data undergoes predetermined image processing in image processing section 30.

Operation/display section 20 is composed of, for example, a touch panel-type liquid crystal display (LCD), and functions as both display section 21 and operation section 22. Display section 21 displays various operation screens, image conditions, operation conditions of each function, and/or the like in accordance with display control signals input from control section 100. Operation section 22 equipped with various operation keys, such as a numeric keypad and a start key, receives various input operation from users and outputs operation signals to control section 100.

Image processing section 30 includes a circuit and/or the like that performs digital image processing of input image data in accordance with default settings or user settings. For example, image processing section 30 performs tone correction based on tone correction data (tone correction table) under the control of control section 100. Moreover, image processing section 30 performs various correction processing, such as color correction or shading correction, in addition to tone correction, compression processing, and/or the like of input image data. Image forming section 40 is controlled based on the processed image data.

Image forming section 40 includes, for example, intermediate transfer unit 42 and image forming units 41Y, 41M, 41C, and 41K for forming images of color toners of Y component, M component, C component, and K component based on input image data.

Image forming units 41Y, 41M, 41C, and 41K for Y component, M component, C component, and K component have similar configurations. For convenience in illustration and description, common components are denoted by the same numerals and such numerals are accompanied by Y, M, C, or K when they are distinguished. In FIG. 1, only components of image forming unit 41Y for Y component are denoted by numerals, and numerals are omitted for components of other image forming units 41M, 41C, and 41K.

Image forming unit 41 includes exposing device 411, developing device 412, photoconductor drum 413 (corresponds to "image bearing member" of the present invention), charging device 414, drum cleaning device 415, and/or the like.

Photoconductor drum 413 is, for example, a negative-charging organic photoconductor (OPC) formed by successively laminating an undercoat layer (UCL), a charge generation layer (CGL), and a charge transport layer (CTL) on a peripheral surface of aluminum conductive cylinder (aluminum tube). The charge generation layer is formed from an organic semiconductor composed of a charge generation material (phthalocyanine pigment, for example) dispersed in a resin binder (polycarbonate, for example), and generates pairs of positive charges and negative charges upon exposure by exposing device 411. The charge transport layer is formed from a hole transport material (electron-donating nitrogen compound) dispersed in a resin binder (polycarbonate, for example), and transports positive charges generated in the charge generation layer to a surface of the charge transport layer.

Control section 100 rotates photoconductor drum 413 at a constant peripheral speed by controlling driving current supplied to a driving motor (not shown) that rotates photoconductor drum 413.

Charging device 414 evenly and negatively charges a surface of photoconductor drum 413. Exposing, device 411 is configured, for example, as a semiconductor laser, and irradiates photoconductor drum 413 with laser beams corresponding to images of respective color components. Thus, positive charges are generated in the charge generation layer of photoconductor drum 413, and transported to the surface of the charge transport layer, thereby neutralizing surface charges (negative charges) of photoconductor drum 413. As a result, an electrostatic latent image of respective color components is formed on the surface of photoconductor drum 413 due to potential differences from the surroundings.

Developing device 412 is, for example, a developing device of a two-component developing system, and forms a toner image by attaching a toner of respective color components to the surface of photoconductor drum 413 to visualize an electrostatic latent image. A specific configuration of developing device 412 will be described hereinafter.

Drum cleaning device 415 includes a drum cleaning blade or the like to be slid on the surface of photoconductor drum 413, and removes transfer residual toner remaining on the surface of photoconductor drum 413 after primary transfer.

Intermediate transfer unit 42 includes intermediate transfer belt 421, primary transfer roller 422, a plurality of support rollers 423, secondary transfer roller 424, belt cleaning device 426, and/or the like.

Intermediate transfer belt 421 is composed of an endless belt, and looped around a plurality of support rollers 423 under tension. At least one of a plurality of support rollers 423 is a driving roller, and the rest are driven rollers. For example, roller 423A, which is disposed on the downstream side of primary transfer roller 422 for K component in the running direction of the belt, is preferably a driving roller. This facilitates the retention of a constant running speed of the belt in a primary transfer section. Intermediate transfer belt 421 runs in arrow A direction at a constant speed by the rotation of driving roller 423A.

Primary transfer roller 422 is disposed facing photoconductor drum 413 for each color component on the inner peripheral surface side of intermediate transfer belt 421. A primary transfer nip, for transferring a toner image to intermediate transfer belt 421 from photoconductor drum 413, is formed by firmly pressing primary transfer roller 422 on photoconductor drum 413 via intermediate transfer belt 421.

Secondary transfer roller 424 is disposed on the outer peripheral surface side of intermediate transfer belt 421, facing backup roller 423B disposed on the downstream side of driving roller 423A in the running direction of the belt. A secondary nip, for transferring a toner image to sheet S from intermediate transfer belt 421, is formed by firmly pressing secondary transfer roller 424 on backup roller 423B via intermediate transfer belt 421.

When intermediate transfer belt 421 passes through the primary transfer nip, toner images on photoconductor drums 413 are successively superimposed and transferred (primary transfer). Specifically, primary transfer bias is applied to primary transfer roller 422 to impart charges of opposite polarity (to toners) to the rear surface side of intermediate transfer belt 421 (contact side with primary transfer roller 422), thereby transferring toner images to intermediate transfer belt 421 electrostatically.

After that, when sheet S passes through the secondary transfer nip, toner images on intermediate transfer belt 421 are transferred to sheet S (secondary transfer). Specifically, secondary transfer bias is applied to secondary transfer roller 424 to impart charges of opposite polarity (to toners) to the rear surface side of sheet S (contact side with secondary transfer roller 424), thereby transferring toner images to sheet S electrostatically. Sheet S bearing transferred toner images is conveyed to fixing section 60.

Belt cleaning section 426 includes a belt cleaning blade or the like to be slid on the surface of intermediate transfer belt 421, and removes transfer residual toner remaining on the surface of intermediate transfer belt 421 after secondary transfer. In place of secondary transfer roller 424, a configuration in which a secondary transfer belt is looped around a plurality of support rollers including a secondary transfer roller under tension (so-called belt-type secondary transfer unit) may be employed.

Fixing section 60 includes upper-side fixing section 60A, which includes a fixing surface-side member disposed on the fixing surface side of sheet S (toner image formed surface), lower-side fixing section 60B, which includes a rear surface side support member disposed on the rear surface side of sheet S (opposite surface to the fixing surface), heating source 60C, and/or the like. A fixing nip, for pinching and conveying sheet S, is formed by firmly pressing the rear surface-side support member on the fixing surface-side member.

Fixing section 60 heats and presses conveyed sheet S in which toner images have been transferred (secondary transfer), thereby fixing toner images on sheet S. Fixing section 60 as a unit is disposed inside fixing device F. Inside fixing device F, also disposed is air separation unit 60D for separating sheet S from the fixing surface-side member.

Sheet conveying section 50 includes sheet feeding section 51, sheet ejection section 52, conveying path section 53, and/or the like. Three sheet feeding tray units 51*a* to 51*c*, which constitute sheet feeding section 51, store sheets S classified based on basis weight, size, or the like (standard paper, special paper) in accordance with predetermined types. Conveying path section 53 includes a plurality of conveying roller pairs, such as registration roller pair 53*a*.

Sheets S stored in sheet feeding tray units 51*a* to 51*c* are each sent out from the topmost portion and conveyed to image forming section 40 through conveying path section 53. During this step, a registration roller section, where registration roller pair 53*a* is disposed, corrects the tilt of sheet S and adjusts the timing of conveyance. Then, toner images on intermediate transfer belt 421 are simultaneously transferred to one-side surface of sheet S in image forming section 40 (second transfer), and a fixing step is performed in fixing section 60. Sheet S bearing a formed image is ejected outside the apparatus by sheet ejection section 52 equipped with sheet ejection roller 52*a*.

In the following, a configuration of developing device 412 will be described with reference to FIG. 3. In the embodiment, developing device 412 employs a two-component developing system.

Figure 3:
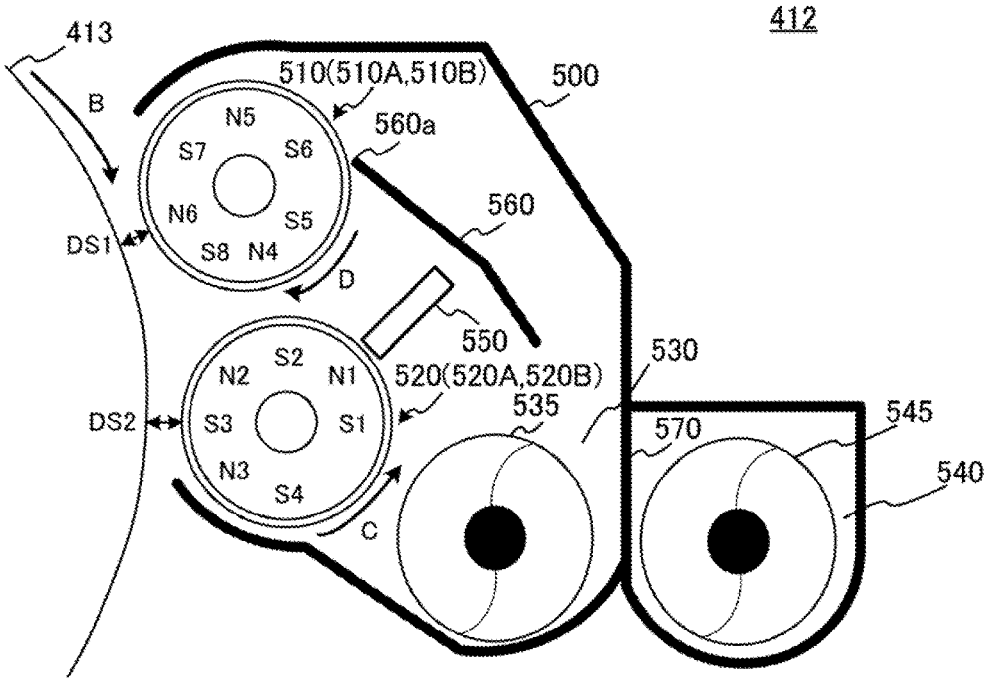
FIG. 3 schematically illustrates a configuration of a developing device according to the embodiment.

As illustrated in FIG. 3, developing device 412 includes housing 500 where a two-component developer containing a toner and a carrier is stored. In a portion of housing 500 open to photoconductor drum 413, provided are first developing roller 510 disposed on the upstream side of the rotation direction of photoconductor drum 413, and second developing roller 520 disposed on the downstream side of the rotation direction of photoconductor drum 413.

Behind the positions where first and second rollers 510 and 520 are provided inside housing 500, first developer storage chamber 530 and second developer storage chamber 540 are provided. Inside first and second developer storage chambers 530 and 540, provided are first stirring/conveying member 535 and second stirring/conveying member 545 that convey a two-component developer while stirring, and supply the two-component developer to second developing roller 520.

In the surroundings of first and second developing rollers 510 and 520, provided are layer restriction member 550, which restricts layer thickness of a two-component developer magnetically adsorbed on an outer peripheral surface of second developing roller 520, and guide member 560, which guides a two-component developer peeled off from an outer peripheral surface of first developing roller 510 to an operating region of first stirring/conveying member 535.

The aforementioned two-component developer (hereinafter referred to as developer) contains a resin toner and a carrier, and in the embodiment, used are a positively charging carrier and a negatively charging toner by stirring. Thus, a positively charged carrier is adsorbed on outer peripheral surfaces of first and second developing rollers 510 and 520, thereby conveying a negatively charged toner attached to around the carrier.

Housing 500 stores a developer and supports first and second developing rollers 510 and 520, first and second stirring/conveying members 535 and 545, layer restriction member 550, and guide member 560 provided inside. In the opening portion, which is provided to face photoconductor drum 413, first and second developing rollers 510 and 520 are arranged to face photoconductor drum 413 via gaps.

First and second stirring/conveying members 535 and 545, disposed along the axes of first and second developing rollers 510 and 520, are screw-type members equipped with helical blades around the central axes. First and second stirring/conveying members 535 and 545 are disposed in parallel via partition wall 570 having openings (not shown) at the both end portions in the axial direction, and each convey a developer in the axial direction. First and second stirring/conveying members 535 and 545 are driven to rotate such that the conveying directions of a developer become opposite to each other. This allows a developer to be transferred between respective stirring regions through the openings (provided in partition wall 570), and thus circulated between first developer storage chamber 530 and second developer storage chamber 540 partitioned with partition wall 570. Thus, a developer is supplied to second developing roller 520 by first stirring/conveying member 535, and magnetically adsorbed on the outer peripheral surface of second developing roller 520.

First developing roller 510 includes first magnet roller 510A and cylindrical first developing sleeve 510B rotatably supported along an outer peripheral surface of first magnet roller 510A. Second developing roller 520 includes second magnet roller 520A and cylindrical second developing sleeve 520B rotatably supported along an outer peripheral surface of second magnet roller 520A.

First and second magnet rollers 510A and 520A, in which a plurality of magnetic poles are created in the circumferential direction, can magnetically adsorb or peel off a developer on or from outer peripheral surfaces of first and second developing sleeves 510B and 520B. The magnetic poles are almost evenly created in the axial directions of first and second magnet rollers 510A and 520A so as to generate almost uniform magnetic fields in the surroundings at any position in the axial directions.

Second developing sleeve 520B of second developing roller 520 is driven to rotate in the direction denoted by arrow C in FIG. 3, namely, to move the peripheral surface in the same direction as photoconductor drum 413 (driven in the direction denoted by arrow B) at a position facing photoconductor drum 413. Also, first developing sleeve 510B of first developing roller 510 is driven in the direction denoted by arrow D. This allows peripheral surfaces of first developing sleeve 510B and second developing sleeve 520B to move in the same direction at a position where first developing sleeve 510B and second developing sleeve 520B face each other, that is, at a position where a developer is transferred. At a position where first developing sleeve 510B and photoconductor drum 413 face each other, their facing peripheral surfaces are driven to rotate/move in the opposite directions.

As illustrated in FIG. 3, magnetic poles created in second magnet roller 520A of second developing roller 520 include adsorbing pole S1 for adsorbing a developer supplied from first stirring/conveying member 535, transferring pole S2, created in a position facing first developing roller 510, for transferring a developer held on second developing sleeve 520B to first developing sleeve 510B, developing pole S3 as a main pole for forming a magnetic brush of a developer toward photoconductor drum 413 at a position facing photoconductor drum 413, conveying poles N1, N2, and N3 for adsorbing a developer on the outer peripheral surface of second developing sleeve 520B and conveying, and peeling pole S4 with the same polarity as adsorbing pole S1 provided to adjoin adsorbing pole S1.

First magnet roller 510A of first developing roller 510 has seven magnetic poles created along the circumferential direction, which include receiving pole N4, created at a position facing second developing roller 520, for receiving a developer from second developing sleeve 520B, developing pole N6 as a main pole for forming a magnetic brush of a developer toward photoconductor drum 413 at a position facing photoconductor drum 413, conveying poles N5, S7, and S8 for adsorbing a developer on the outer peripheral surface of first developing sleeve 510B and conveying, and two peeling poles S5 and S6 with the same polarity created in the circumferential direction via a gap for peeling off a developer with repulsive magnetic fields. Magnetic poles S1 to S8 are south poles, and magnetic poles N1 to N6 are north poles.

DC/AC superimposed voltage as developing bias voltage is applied to first and second developing rollers 510 and 520 by a DC power supply (not shown).

Layer restriction member 550 is a sheet member provided so that the tip edge faces the outer peripheral surface of second developing sleeve 550B, and restricts the amount of a developer adsorbed on second developing sleeve 550B and moved. Layer restriction member 550 is disposed on the downstream side of a position where a developer is supplied to second developing roller 520 from first stirring/conveying member 535 in the moving direction of the outer peripheral surface of second developing sleeve 520B.

Guide member 560 is a sheet member disposed so that the tip 560*a* faces an outer peripheral surface of first developing sleeve 510B in a region where repulsive magnetic fields by peeling poles S5 and S6 (provided in first magnet roller 510A) are exerted. Guide member 560 guides a developer peeled off from first developing sleeve 510B along the sheet surface toward a region where a developer is stirred by first stirring/conveying member 535 inside housing 500.

When the amount of a developer stored inside developing device 412 decreases, developing device 412 is detached from the body of image forming apparatus 1 and replaced. When developing device 412 is replaced, the positional relationship between receiving pole N4 of first developing roller 510 and transferring pole S2 of second developing roller 520 is sometimes distorted in the axial directions of first and second developing rollers 510 and 520 depending on the installation state after the replacement. This causes variations in the amount of a developer conveyed from developing sleeve 520B to developing sleeve 510B in the axial directions.

More specifically, there is a case in which the rotational axis of photoconductor drum 413 and the rotational axis of second developing roller 520 fail to align in parallel (when distorted) during setting of gap DS2 between photoconductor drum 413 and second developing roller 520 (see FIG. 3). In such a case, the later setting of gap DS1 between photoconductor drum 413 and first developing roller 510 (see FIG. 3) results in distortion between receiving pole N4 of first developing roller 510 and transferring pole S2 of second developing roller 520 in the axial direction due to the effects of the curvature of photoconductor drum 413. As a result, variations in the amount of a developer conveyed from developing sleeve 520B to developing sleeve 510B arise in the axial directions of first and second developing rollers 510 and 520, and thus variations in the amount of a developer conveyed from first and second developing rollers 510 and 520 to photoconductor drum 413 arise in the rotational axis direction of photoconductor drum 413, resulting in uneven development.

The aforementioned uneven development arises even when developing device 412 includes only one developing roller, different from the embodiment. In other words, when developing device 412 is replaced, developing device 412 (more specifically, a developing roller for supplying a developer to photoconductor drum 413) sometimes fails to be disposed at an accurate position relative to photoconductor drum 413 depending on the installation state after the replacement. In this case, the rotational axis of photoconductor drum 413 and the rotational axis of the developing roller fail to align in parallel, and thus variations in the amount of a developer conveyed from the developing roller to photoconductor drum 413 result, causing uneven development.

In order to prevent the occurrence of the aforementioned uneven development, in the embodiment, first magnet roller 510A is configured such that the relative position thereof to first developing sleeve 510B is changeable so as to align the axial direction of first magnet roller 510A and the axial direction of second magnet roller 520A in parallel. Also, first magnet roller 510A is configured such that the relative rotation position thereof to first developing sleeve 510B is changeable. Further, second magnet roller 520A is configured such that the relative rotation position thereof to second developing sleeve 520B is changeable.

When developing device 412 having the above configuration is replaced, the following four adjustments are made during the installation after the replacement. First, an adjustment of the gap between photoconductor drum 413 and second developing roller 520 is made (hereinafter also referred to as "first adjustment"). Then, an adjustment of the rotation position of second magnet roller 520A (developing pole S3) of second developing roller 520 is made (hereinafter also referred to as "second adjustment"). Next, an adjustment of the gap between photoconductor drum 413 and first developing roller 510 is made (hereinafter also referred to as "third adjustment"). Finally, adjustments of the relative position and the relative rotation position of first magnet roller 510A (receiving pole N4) of first developing roller 510 relative to first developing sleeve 510B are made (hereinafter also referred to as "fourth adjustment").

Figure 4A:
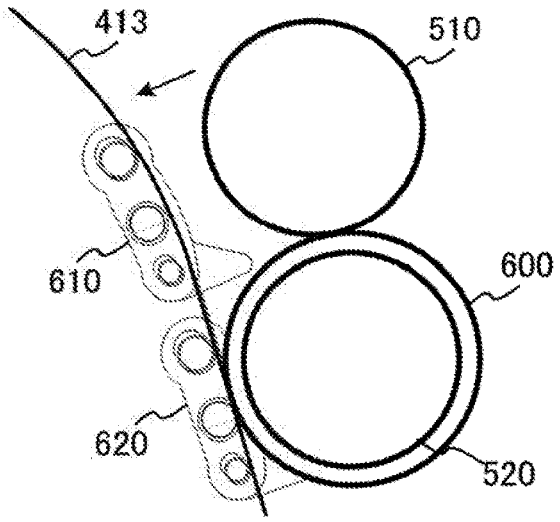
FIGS. 4A and 4B illustrate the state of gap adjustment according to the embodiment.
Figure 6:
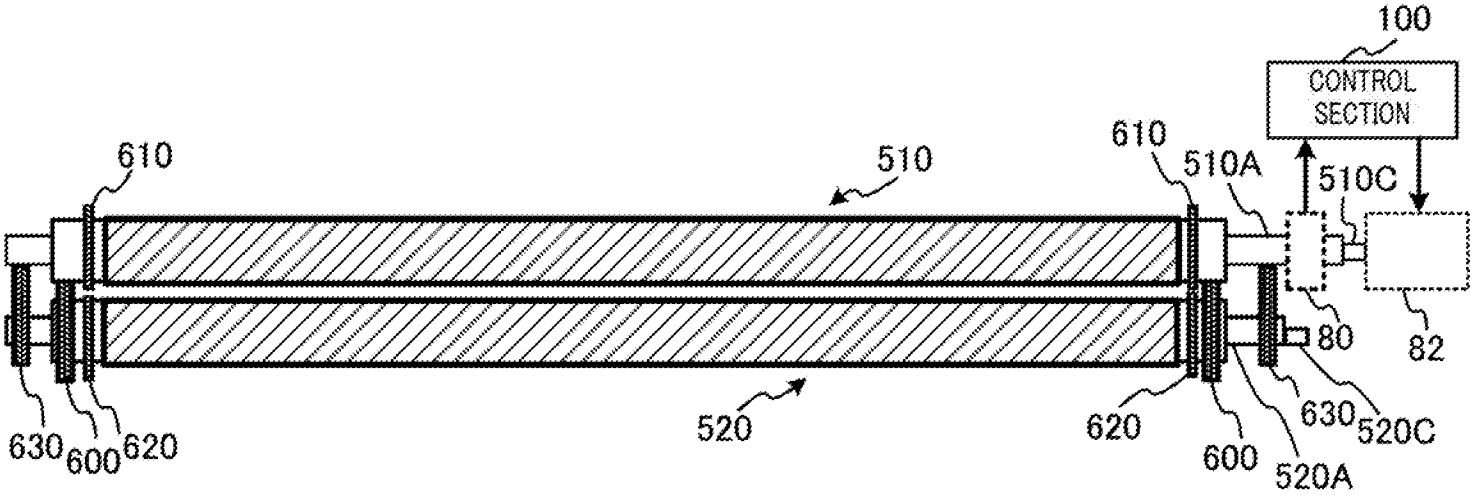
FIG. 6 illustrates a peripheral configuration of first and second developing rollers viewed from a photoconductor drum side.

As illustrated in FIG. 4A, in the first adjustment, second developing roller 520 is hit on photoconductor drum 413 via second adjustment members 620 and the position of second developing roller 520 is adjusted so that the gap between photoconductor drum 413 and second developing roller 520 becomes DS2 (designed value). As illustrated in FIGS. 4A and 6, second adjustment members 620 are provided at positions facing both axial end portions of second developing roller 520. The gap between photoconductor drum 413 and second developing roller 520 is adjusted to DS2 by moving second developing roller 520 toward photoconductor drum 413 so that the both axial end portions of second developing roller 520 come into contact with one-side end faces of second adjustment members 620.

In the second adjustment, for suitable developing efficiency of second developing roller 520 toward photoconductor drum 413, second magnet roller 520A is rotated with a rotation position adjustment member (not shown) to adjust the rotation position of second magnet roller 520A (especially, developing pole S3). As illustrated in FIGS. 5A, 5B, 5C, and 6, axial end portion 520C of second magnet roller 520A has a D-cut shape in the embodiment. Thus, second magnet roller 520A can be easily rotated by pinching axial end portion 520C with the rotation position adjustment member.

After the first and second adjustments are made to second developing roller 520, second developing roller 520 is fixed to housing 500 for development device 412 via a sheet metal (not shown).

Figure 4B:
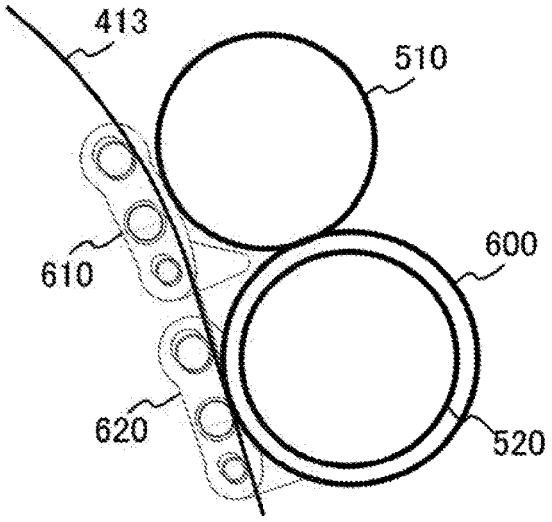

As illustrated in FIG. 4B, in the third adjustment, first developing roller 510 is hit on photoconductor drum 413 via first adjustment members 610 and the position of first developing roller 510 is adjusted so that the gap between photoconductor drum 413 and first developing roller 510 becomes DS1 (designed value). As illustrated in FIGS. 4A and 6, first adjustment members 610 are provided at positions facing both axial end portions of first developing roller 510. The gap between photoconductor drum 413 and first developing roller 510 is adjusted to DS1 by moving first developing roller 510 toward photoconductor drum 413 so that the both axial end portions of first developing roller 510 come into contact with one-side end faces of first adjustment members 610.

In the embodiment, first developing roller 510 is moved toward one-side end faces of first adjustment members 610 in a state where a distance between the center of first developing roller 510 and the center of second developing roller 520 is constant. Specifically, as illustrated in FIGS. 4A, 4B, and 6, first developing roller 510, by its own weight, hits on ring-shaped roller gap adjustment member 600 (which is provided in both axial end portions of second developing roller 520 and outside second adjustment members 620 (see FIG. 4A)), and moves toward one-side end faces of first adjustment members 610 along the circumference of roller gap adjustment member 600.

Figure 5A:
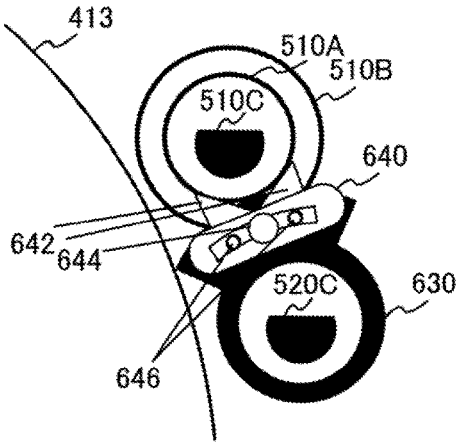
FIGS. 5A, 5B, and 5C illustrate the state of changing a relative position and a relative rotation position according to the embodiment.
Figure 5B:
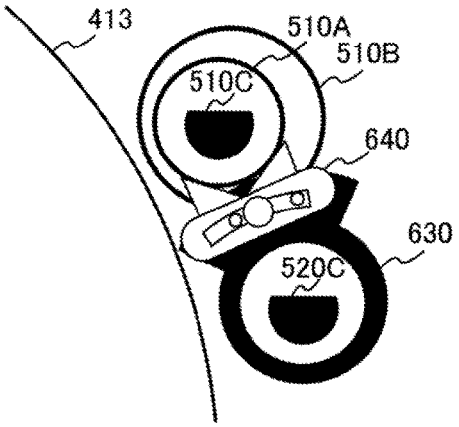
Figure 5C:
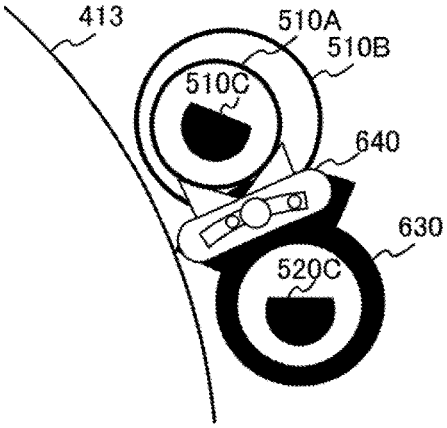

As illustrated in FIGS. 5A, 5B, and 5C, in the fourth adjustment, a relative position of first magnet roller 510A to first developing sleeve 510B is changed using holding member 630 and moving member 640 while a relative rotation position of first magnet roller 510A to first developing sleeve 510B is changed. Holding member 630 and moving member 640 correspond to "a changing member" of the present invention.

As illustrated in FIG. 6, holding members 630, which are installed near the end portions of second magnet roller 520A, are a member having a ring portion and a circular arc portion. As illustrated in FIGS. 5A, 5B, 5C, and 6, the top surface of the circular arc portion of holding member 630 comes into contact with the outer peripheral surface of first magnet roller 510A. Pinching sections 642 capable of pinching first magnet roller 510A, and moving member 640 having shoulder screw 644 are disposed in the circular arc portion of holding member 630. Moving member 640 is configured to be movable along the circumferential shape of the circular arc portion of holding member 530 in a state where first magnet roller 510A is pinched with pinching section 642. Numeral 646 in FIG. 5A denotes pins which are fixed to housing 500 for developing device 412 and define the moving range of moving member 640.

FIG. 5A illustrates a state before moving in which moving member 640 pinches first magnet roller 510A with pinching sections 642. FIG. 5B illustrates a state after moving in which moving member 640 pinches first magnet roller 510A with pinching sections 642. Moving member 640 is moved so that the axial direction of first magnet roller 510A and the axial direction of second magnet roller 520A align in parallel, in other words, a distance between the central position of first magnet roller 510A and the central position of second magnet roller 520A in the axial directions of first and second magnet rollers 510A and 520A becomes constant.

After completing the movement of moving member 640, shoulder screw 644 is tightened. Thus, moving member 640 is fixed to holding member 630 at a position after the movement.

Moreover, first magnet roller 510A is rotated to adjust the rotation position of first magnet roller 510A (especially, receiving pole N4) relative to first developing sleeve 510B for preferable receiving efficiency of a developer from transferring pole S2 of second developing roller 520 to receiving pole N4 of first developing roller 510, as well as preferable developing efficiency of first developing roller 510 toward photoconductor drum 413.

In the fourth adjustment, a relative position and a relative rotation position of first magnet roller 510A to first developing sleeve 510B are changed, based on fluctuations in rotational torque of first magnet roller 510A when first magnet roller 510A is rotated in a state where moving member 640 is moved to a specific position.

As illustrated in FIGS. 2 and 6, rotation driving section 82 is controlled by control section 100 and rotates first magnet roller 510A. As illustrated in FIGS. 5A, 5B, 5C, and 6, axial end portion 510C of first magnet roller 510A has a D-cut shape in the embodiment. Thus, rotation driving section 82 can easily rotate first magnet roller 510A by pinching axial end portion 510C. FIG. 5C illustrates a state after first magnet roller 510A has been rotated. Rotational torque measuring section 80 measures rotational torque of first magnet roller 510A rotated by rotation driving section 82, and outputs the measured rotational torque to control section 100.

Figure 7A:
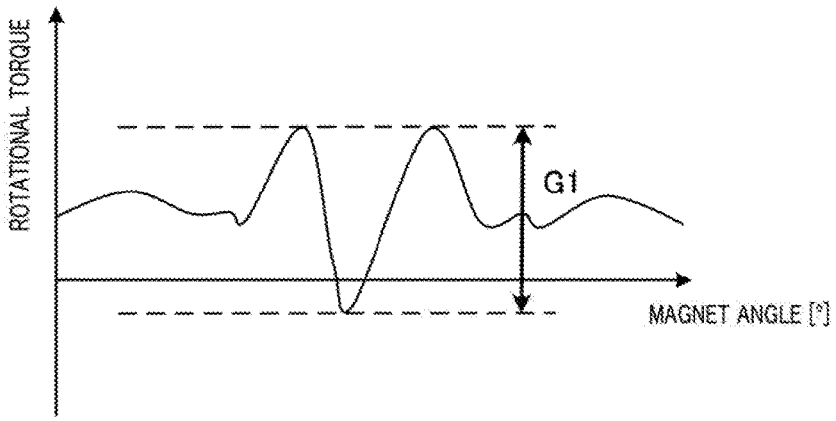
FIGS. 7A and 7B show measured results of rotational torques for a first magnet roller according to the embodiment.

FIG. 7A shows fluctuations in rotational torque of first magnet roller 510A when first magnet roller 510A is rotated in a state where moving member 640 is moved to a first position (position where the axial direction of first magnet roller 510A and the axial direction of second magnet roller 520A align in parallel). As shown in FIG. 7A, when moving member 640 is positioned in the first position, facing magnetic poles inside first and second magnet rollers 510A and 520A maximize magnetic flux density and generate intense attractive force, resulting in larger than a predetermined value of difference G1 between the maximum and minimum values of rotational torque.

Figure 7B:
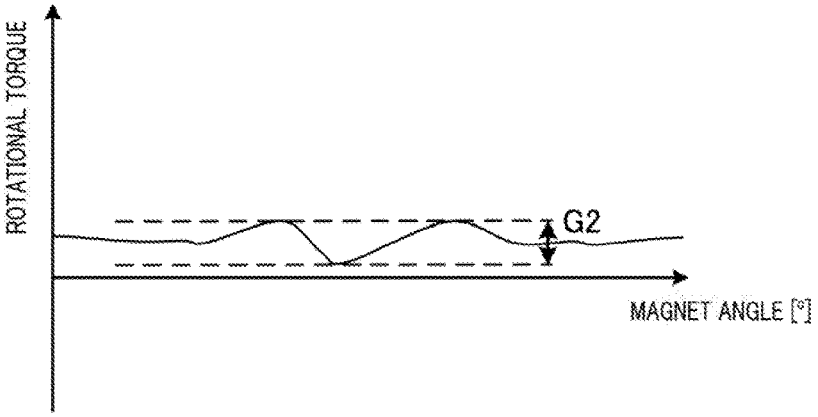

FIG. 7B shows fluctuations in rotational torque of first magnet roller 510A when first magnet roller 510A is rotated in a state where moving member 640 is moved to a second position (position where the axial direction of first magnet roller 510A and the axial direction of second magnet roller 520A fail to align in parallel). As shown in FIG. 7B, when moving member 640 is positioned in the second position, facing magnetic poles inside first and second magnet rollers 510A and 520A fail to maximize magnetic flux density and weaken attractive force, resulting in smaller than a predetermined value of difference G2 between the maximum and minimum values of rotational torque.

Accordingly, in the fourth adjustment, the first position where the axial direction of first magnet roller 510A and the axial direction of second magnet roller 520A are aligned in parallel is determined by shifting moving member 640 to a specific position, rotating first magnet roller 510A, determining rotational torque, and repeating these steps. Subsequently, moving member 640 is moved to the first position, and in such a state, first magnet roller 510A is rotated. Then, determined is a rotation position (magnet angle) in which rotational torque becomes minimum when magnetic poles inside first and second magnetic rollers 510A and 520A are positioned facing each other, maximizing magnetic flux density and generating intense attractive force. Then, first magnet roller 510A is rotated to the rotation position in which rotational torque becomes minimum. This terminates the fourth adjustment.

Figure 8:
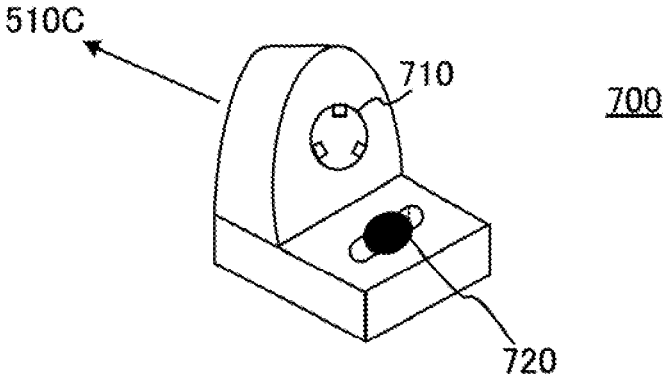
FIG. 8 illustrates a configuration of a fixing member according to the embodiment.

Finally, first magnet roller 510A is fixed to housing 500 for developing device 412 using fixing member 700 (see FIG. 8) provided at the end portion in the axial direction of first magnet roller 510A. As illustrated in FIG. 8, fixing member 700 includes pinching section 710 that can pinch axial end portion 510C of first magnet roller 510A, and shoulder screw 720. After the end of the fourth adjustment, fixing member 700 is fixed to housing 500 by tightening shoulder screw 720. Thus, a relative position and a relative rotation position of first magnet roller 510A to first developing sleeve 510B are fixed.

As described in detail above, the embodiment prevents distorted positional relationship between receiving pole N4 of first developing roller 510 and transferring pole S2 of second-developing roller 520 in the axial directions of first and second developing rollers 510 and 520, as well as prevents variations in the amount of a developer conveyed from second developing sleeve 520B to first developing sleeve 510B in the axial directions, by making the first to the fourth adjustments after developing device 412 is replaced. Consequently, variations in the amount of a developer conveyed from first and second developing rollers 510 and 520 to photoconductor drum 413 in the rotational axis direction of photoconductor drum 413 are prevented, and thus uneven development is prevented.

Also, in a case where developing device 412 includes only one developing roller, the rotational axis of photoconductor drum 413 and the rotational axis of the developing roller align in parallel by changing/adjusting a relative position of a magnet roller to a developing sleeve after developing device 412 is replaced. As a result, the occurrence of variations in the amount of a developer conveyed from the developing roller to photoconductor drum 413 in the rotational axis direction of photoconductor drum 413 is prevented, and thus the occurrence of uneven development is prevented.

The above embodiment describes an example in which first magnet roller 510A is configured such that the relative position thereof to first developing sleeve 510B is changeable so as to align the axial direction of first magnet roller 510A and the axial direction of second magnet roller 520A in parallel. The present invention, however, is not limited to this. For example, second magnet roller 520A may be configured such that the relative position thereof to second developing sleeve 520B is changeable so as to align the axial direction of first magnet roller 510A and the axial direction of second magnet roller 520A in parallel.

The embodiments disclosed herein are mere exemplifications of the present invention, and should not be construed as limiting the technical scope of the present invention in any way. Specifically, modifications are possible without departing from the spirit or scope of the present invention.

What is claimed is:

1. A developing device comprising:

a first developing roller (i) including at least a first magnet roller, (ii) having a plurality of magnetic poles in a circumferential direction, and (iii) including a developing sleeve rotatably supported along an outer peripheral surface of the magnet roller, wherein the first developing roller is configured to supply a toner to an image bearing member, an axial direction of the first magnet roller is configured to align in parallel to an axial direction of a second magnet roller by changing a relative position of the first magnet roller with respect to the developing sleeve.

2. The developing device according to claim 1, wherein the developing device further includes a second developing roller, said second developing roller including the second magnet roller and a second developing sleeve, wherein the second magnet roller of the second developing roller is configured such that a relative position thereof to the second developing sleeve is changeable.

3. The developing device according to claim 2, wherein the first developing roller is disposed on an upstream side of a rotation direction of the image bearing member and the second developing roller is disposed on a downstream side of the rotation direction of the image bearing member.

4. The developing device according to claim 3, wherein the first developing roller rotates so that a peripheral surface of the first developing roller moves in an opposite direction to that of the image bearing member at a position facing the image bearing member; and the second developing roller rotates so that a peripheral surface of the second developing roller moves in a same direction as that of the image bearing member at a position facing the image bearing member.

5. The developing device according to claim 3, wherein an amount of a developer to be borne on the first developing roller is not restricted, whereas an amount of a developer to be borne on the second developing roller is restricted.

6. The developing device according to claim 3, wherein the relative position and a relative rotation position of the first magnet roller are changed in accordance with a fluctuation in rotational torque of the first magnet roller, the fluctuation resulting when the relative position and the relative rotation position are changed.

7. The developing device according to claim 6, wherein the relative position is changed using a changing member provided at an end portion in an axial direction of the second magnet roller.

8. The developing device according to claim 7, wherein after the relative rotation position is changed, the first magnet roller is fixed to a housing for the developing device, using a fixing member provided at an end portion in an axial direction of the first magnet roller.

9. An image forming apparatus comprising the developing device according to claim 1.

* * * * *